US005752291A

United States Patent [19]

Snyder

[11] Patent Number: 5,752,291

[45] Date of Patent: May 19, 1998

[54] ADJUSTABLE BUTT HINGE

[75] Inventor: Michael Snyder, Bridgewater, N.J.

[73] Assignee: Olympus Optical Co., Ltd., Tokyo, Japan

[21] Appl. No.: 540,014

[22] Filed: Oct. 6, 1995

[51] Int. Cl.[6] ..... E05D 7/04

[52] U.S. Cl. ..... 16/235; 16/247; 16/251

[58] Field of Search ..... 16/235–237, 247, 16/249, 251, 238

[56] References Cited

U.S. PATENT DOCUMENTS

| | | | |
|---|---|---|---|
| 403,572 | 5/1889 | Boda | 16/249 |
| 1,141,303 | 6/1915 | Bennett et al. | 16/249 |
| 1,742,455 | 1/1930 | Walter et al. | 16/249 |
| 2,027,888 | 1/1936 | Soloman | 16/249 |
| 2,373,955 | 4/1945 | Fuller | 16/238 |
| 2,615,194 | 10/1952 | Kreiner | 16/237 |
| 2,744,284 | 5/1956 | McMillan | 16/247 |
| 3,019,472 | 2/1962 | Wasmuth | 16/249 |
| 3,229,323 | 1/1966 | Hensgen | 16/247 |
| 4,639,971 | 2/1987 | Kurtz | 16/247 |

FOREIGN PATENT DOCUMENTS

| | | | |
|---|---|---|---|
| 2455805 | 6/1975 | Germany | 16/238 |
| 5-222878 | 8/1993 | Japan | 16/235 |
| 2225608 | 6/1990 | United Kingdom | 16/249 |

*Primary Examiner*—Chuck Mah
*Assistant Examiner*—Donald M. Gurley
*Attorney, Agent, or Firm*—Louis Weinstein

[57] ABSTRACT

A butt hinge is comprised of first and second swingably coupled hinge plates. At least one of the hinge plates is provided with clearance openings to enable the said one hinge plate to be moved over a given range relative to portions of wood screws passing through said clearance openings. A trim plate overlies the said one hinge plate. The wood screws are tightened, sandwiching the said one hinge plate between a base of a mortise and the trim plate to maintain the hinge plate in proper alignment. Engaging surfaces of the hinge plate and trim plate may be roughened to enhance the clamping therebetween. The hinge plate may be provided with set screws threadedly engaging tapped openings in the hinge plate so as to project from the hinge plate surface to compensate for applications in which a depth of a mortise is greater than the combined thickness of the hinge plate and trim plate to bring the exposed surface of the trim plate flush with the surface in which the mortise is formed. Alternatively, one or more shims may be utilized as a substitute for the set screws.

4 Claims, 4 Drawing Sheets

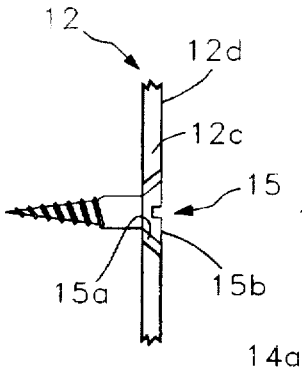
FIG. 4d
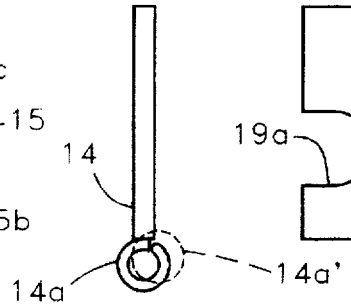
FIG. 4c
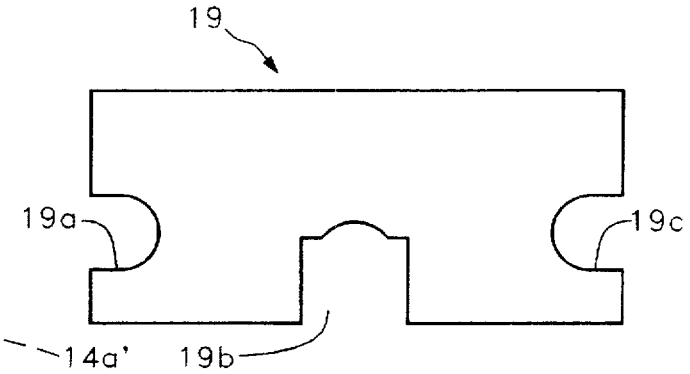
FIG. 5
FIG. 6a
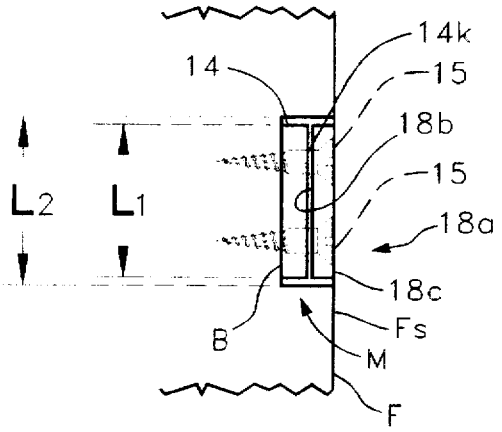
FIG. 6b
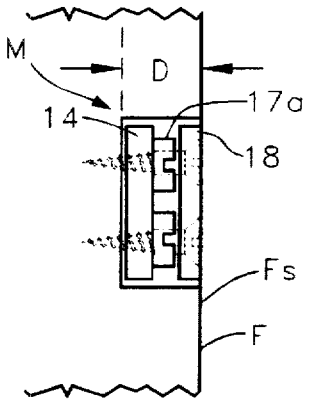
FIG. 6c
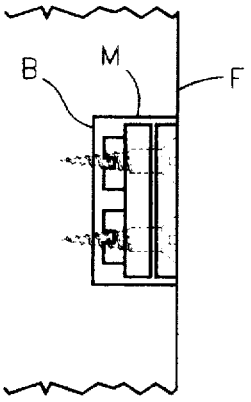
FIG. 6d
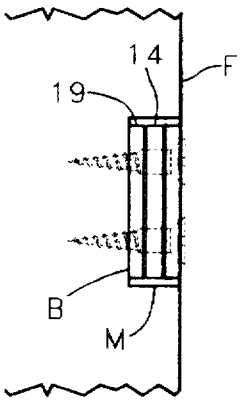

ADJUSTABLE BUTT HINGE

FIELD OF THE INVENTION

This invention relates to butt hinges and more particularly to a butt hinge assembly whose design makes it possible to easily and readily adjust the butt hinge after mounting.

BACKGROUND OF THE INVENTION

Doors, for cabinets or room or house entrances are typically mounted utilizing butt hinges. The mounting of the butt hinge upon the door and door frame (or door jamb, as the case may be) requires a substantially exacting mounting of the butt hinge on both the door and frame. Misalignment, whether due to poor or improper mounting or due to settling of a structure, which is quite predominant in new home and commercial or industrial construction, can cause sticking or jamming of the doors as well as scraping of the door and door frame members or door and floor, leading to scratching and/or removal of finishes on such surfaces leading to the need for protective measures which go beyond those requiring rehanging of a door.

To date, there is no butt hinge design, which provides for convenient realignment or readjustment other than the complete removal and rehanging of the door and the butt hinges, and, in many cases may even require the use of a new door and door frame members.

BRIEF DESCRIPTION OF THE INVENTION

The present invention is characterized by comprising a butt hinge assembly comprised of a pair of hinge plates swingably coupled to one another by means of a hinge pin. Openings are provided in each hinge plate for receiving threaded fasteners, which are typically wood screws, for securing the hinge plates respectively to the door and door frame. However, one of the hinge plates is provided with oversized openings, i.e. openings which are substantially larger in size than the wood screws passing therethrough, allowing movement of the hinge plate with the oversized openings relative to the wood screws to affect adjustment thereof to thereby provide realignment of the hinge plate relative to the door frame, or door, as the case may be.

The hinge plate with the oversized openings is secured to the door frame (or door) by means of a trim or cover plate which overlies the hinge plate provided with the oversized openings (hereinafter referred to as the adjustable hinge plate).

The trim plate overlies the adjustable hinge plate. The wood screws are threaded through openings in the trim plate and the oversized openings in the adjustable hinge plate. The adjustable hinge plate is "sandwiched" between the door frame (or door) and the trim plate, the wood screws being fastened sufficiently to retain the adjustable hinge plate in the desired position once it has been aligned.

The oversized openings in the hinge plate may be of any desired shape, i.e. either circular, oval, oblong etc. In addition, the oversized openings may be extended to adjacent edges of the hinge plate so as to define slotted openings.

Engaging surfaces of the trim plate or the adjustable plate, or both, may be knurled or otherwise roughened to enhance the clamping strength for retaining the hinge plate in the desired alignment.

The adjustable hinge plate may be positioned against the door frame or the door or alternatively both hinge plates of a butt hinge may be made adjustable and provided with respective trim plates, if desired.

OBJECTS OF THE INVENTION

It is therefore one object of the present invention to provide a novel butt hinge design which permits simplified realignment of a door after it has been mounted.

Still another object of the present invention is to drive a novel butt hinge assembly employing at least one adjustable hinge plate and a cooperating trim plate wherein the hinge plate is designed so as to be adjustable relative to the surface upon which it is mounted while the trim plate serves as the means for maintaining the adjustable hinge plate in the desired position.

Still another object of the present invention is to provide a novel hinge plate assembly of the type described herein wherein the adjustable hinge plate or the trim plate, or both, have knurled or roughened surfaces to further enhance the clamping capability of the butt hinge assembly for maintaining the hinge plate assembly in the desired position.

BRIEF DESCRIPTION OF THE FIGURES

The above as well as other objects of the present invention will become apparent when reading the accompanying description and drawings in which:

FIG. 4*c* shows an end view of the hinge plate of FIG. 4*a*.

FIG. 4*d* shows a detailed view of the manner in which a wood screw is secured against a trim plate.

FIG. 5 shows a plan view of a shim plate usable with a butt hinge assembly of FIG. 1 and the trim plate of FIGS. 3*a* and 3*b* in certain applications.

FIGS. 6*a* through 6*d* show elevational views of the manner in which the adjustable hinge plate may be mounted to a door frame (or door).

DETAILED DESCRIPTION OF THE INVENTION AND PREFERRED EMBODIMENTS THEREOF

Figure 1:
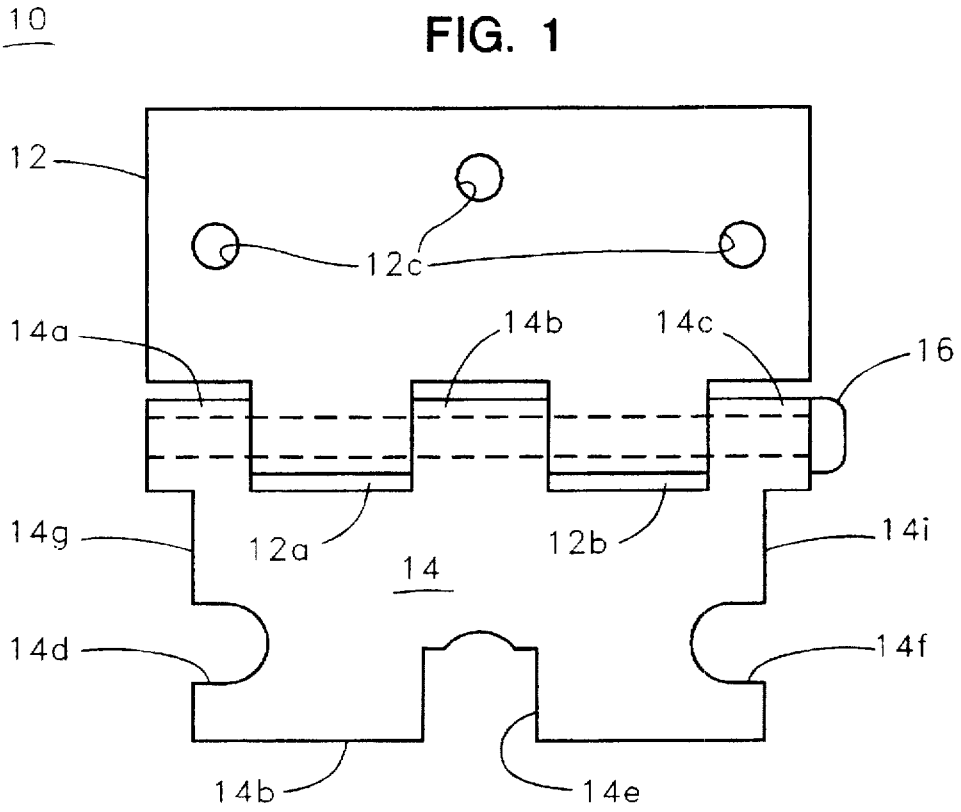
FIG. 1 shows a plan view of an assembled butt hinge.
Figure 2:
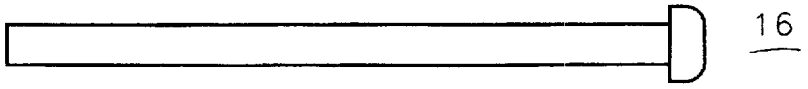
FIG. 2 shows a plan view of the hinge pin employed in the assembly of FIG. 1.
Figure 3A:
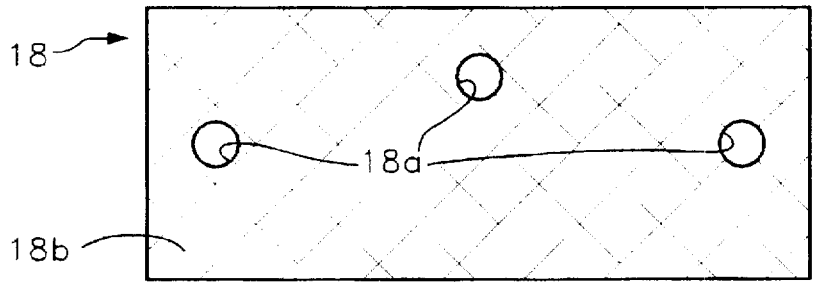
FIGS. 3*a* and 3*b* respectively show plan and end views of a trim plate utilized to secure the butt hinge assembly of FIG. 1 to a door frame (or door).
Figure 3B:
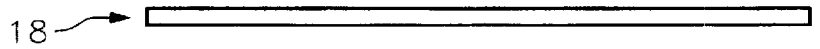
Figure 3C:
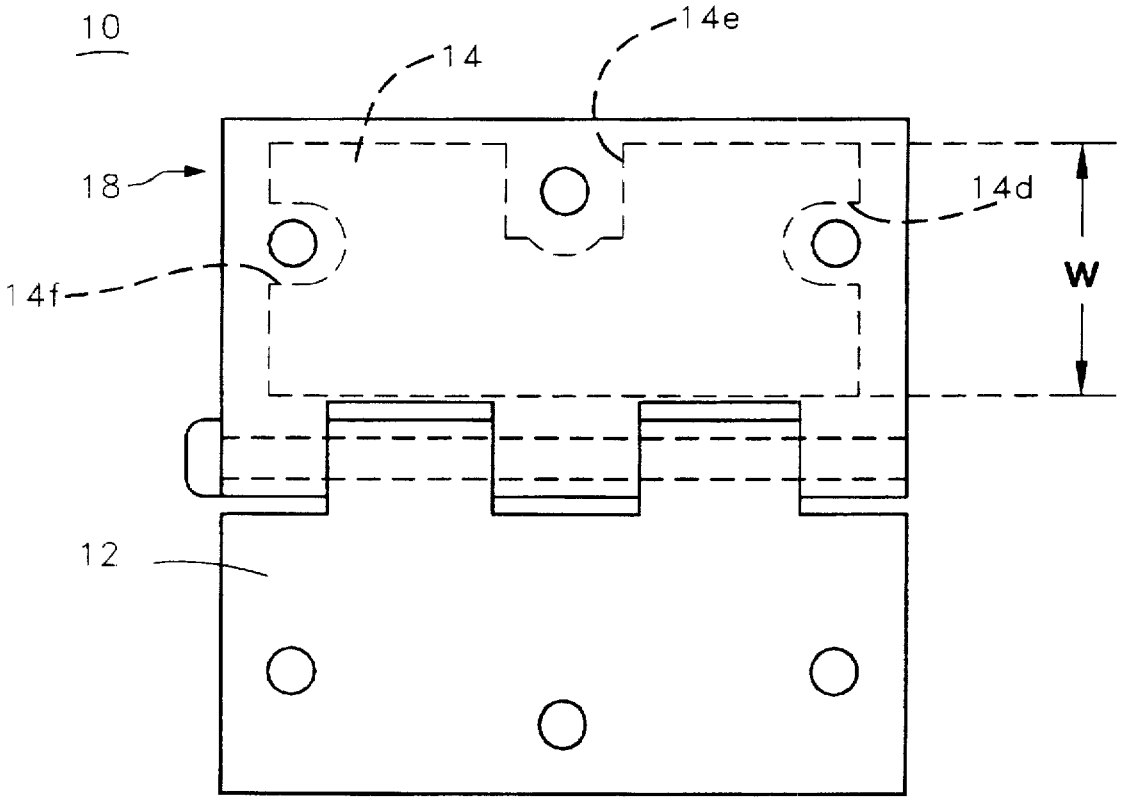
FIG. 3*c* is a plan view showing the manner in which the trim plate is arranged over the associated hinge plate.

FIGS. 1 and 3*c* show a butt hinge assembly 10 designed in accordance with the principles of the present invention and comprised of a pair of hinge plates 12 and 14 (see FIGS. 4*a* and 4*b*, respectively) having sleeves joined to one another by a hinge pin 16 (see FIG. 2).

Hinge plate 12 is provided with a pair of knuckles or sleeves 12*a*, 12*b* forming hollow, substantially cylindrical shaped sleeves which are coaxially aligned, and which interlock with similar coaxially aligned sleeves 14, 14*b* and 14*c* in the manner shown in FIG. 1 to receive pin 16 enabling the hinge plates to be swingably mounted to one another.

Hinge plate 12 is provided with a plurality of circular-shaped openings 12*c* for receiving threaded fasteners such as wood screws, to be more fully described, for securing hinge plate 12 to a mounting surface, such as, for example, a door.

Hinge plate 14, hereinafter referred to as an adjustable hinge plate, is provided with a plurality of elongated slots which communicate with adjacent edges 14*g*, 14*h* and 14*i*, respectively.

The openings 12c in hinge plate 12 have a diameter which is substantially the same as an outer diameter of a threaded fastener such as a screw, and preferably, as shown in detail in FIG. 4d, are provided with openings 12c that are beveled to conform with the tapered head portion 15a of a threaded fastener 15 in order that the outer surface 15b of the head of screw 15 be flush with the outer surface 12d of hinge plate 12.

The slotted openings 14d–14f of adjustable hinge plate 14 are significantly greater in size than the diameter of the portion of the threaded fasteners 15 which extend through the dotted opening to facilitate adjustment of the butt hinge assembly in a manner to be more fully described hereinbelow.

The butt hinge assembly 10 further includes trim plate 18 which has a substantially rectangular-shaped perimeter, and is provided with openings 18a, each of which is aligned to overlie one of the slots 14d–14f in the manner shown best in FIG. 3, plate 18 overlying plate 14, as shown.

The openings 18a in trim plate 18 are also preferably beveled in the manner shown in FIG. 4d to enable the surfaces of the heads of fastening screws 15 to be flush with the exposed outer surface of trim plate 18.

The manner in which the butt hinge assembly of the present invention is utilized as follows:

Appropriate mortises M (see FIGS. 6a–6d) are formed in the door frame and door to receive the butt hinges. Typically at least two butt hinges are provided to mount a door to a door frame. If desired, more than two butt hinges may be employed without departing from the spirit or scope of the present invention.

The hinge plate 12 is typically mounted within the mortise provided in the door and is secured thereto by wood screws similar to the wood screw 15 shown in detail in FIG. 4d.

The adjustable hinge plate 14 is placed within the mortise formed therefor within the door frame and trim plate 18 is positioned over the adjustable hinge plate 14 so as to occupy the position shown, for example, in FIG. 3c. Wood screws 15 are passed through openings 18a in trim plate 18 and through the clearance slots 14d–14f. When the butt hinges, and hence the door, are properly aligned, the wood screws are tightened, causing the adjustable hinge plate 14, which is sandwiched between the base of the mortise in the door frame and the trim plate, to be firmly locked therebetween and maintained in the desired position. There is sufficient clearance between the shank of the wood screw and the openings 14d–14f to enable a significant amount of adjustment and/or alignment of the adjustable hinge plate within the mortise. Note also that the length of the hinge plate $L_1$ is less than the distance $L_2$ between the side walls of the mortise adjacent thereto allowing for adjustment of hinge plate 14 up or down within mortise M. The width W of the adjustable hinge plate is preferably also less than the width of the mortise to facilitate horizontal adjustment of the adjustable hinge plate relative to the door frame thereby providing for adjustment in mutually perpendicular directions, i.e. vertically upwardly or downwardly and horizontally inwardly or outwardly. Typically, the horizontal adjustment range may be less than the vertical adjustment range.

Either the major face 14k of adjustable hinge plate 14 or the major face 18b of trim plate 18, or both, are knurled or otherwise machined to present roughened surfaces which enhance the ability of the trim plate to retain the adjustable hinge plate 14, which is sandwiched between the base of the door frame and the trim plate, in proper alignment.

Assuming that the butt hinge assemblies have been properly mounted and aligned, and that misalignment results due to settlement or the like, realignment is performed simply by loosening the wood screws 15 holding the trim plates firmly against the adjustable hinge plates 14, realigning the adjustable hinge plates 14 and retightening the wood screws.

FIG. 6a shows an end view of an adjustable hinge plate 14 mounted within a mortise M of a door frame F, and an overlying trim plate 18 secured to the door frame F by wood screws 15. The adjustable hinge plate 14 is maintained in position sandwiched between the base B of mortise M and trim plate 18 by the wood screws 15.

When a door frame is properly mortised, the depth D of the mortise is preferably equal to the combined thickness of the trim plate 18 and adjustable hinge plate 14 so that the exposed outer surface 18c of trim plate 18 is flush with the adjacent surface $F_s$ of the door frame F.

FIGS. 6b, 6c and 6d show alternative embodiments for accommodating installations in which the depth of the mortise is greater than the combined thicknesses of the trim plate 18 and adjustable hinge plate 14.

Figures 4A, 4B:
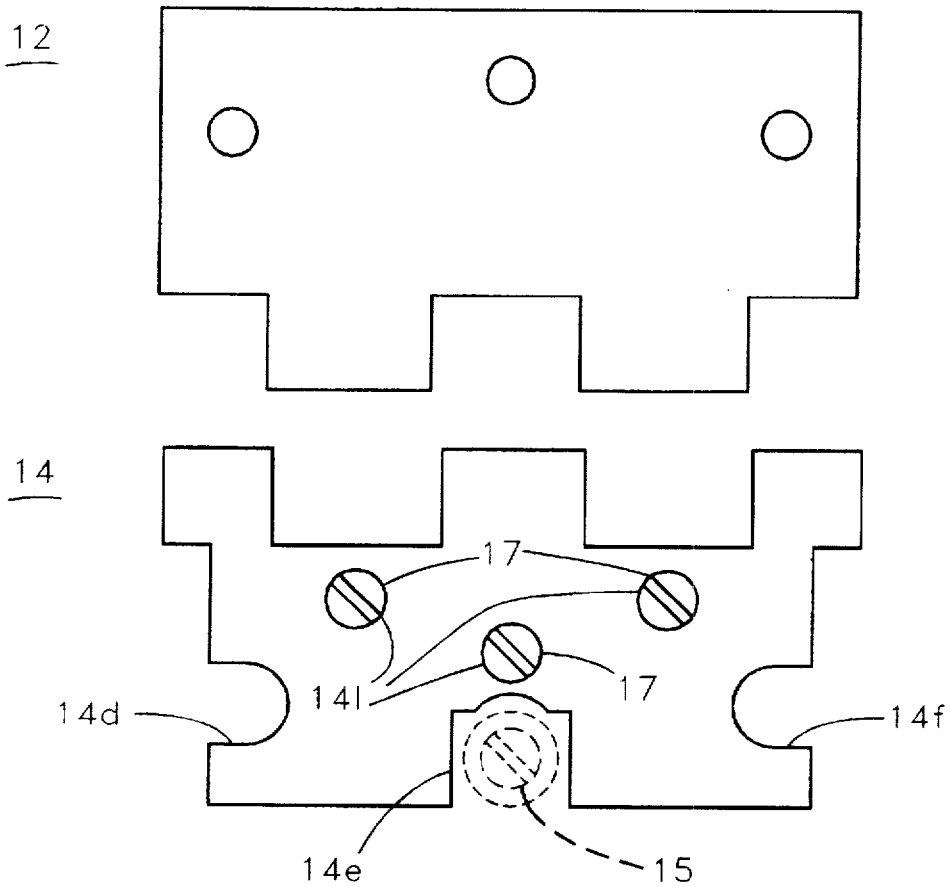
FIGS. 4*a* and 4*b* show plan views of the hinge plates employed in the butt hinge assembly of FIG. 1.

Considering the embodiment of FIG. 6b, the hinge plate 14, as shown in FIG. 4b, is provided with tapped openings 141 which are threadedly engaged by an associated set screw 17. In the embodiment shown in FIG. 6b, the heads 17a of the set screws 17 may be rotated to extend in the direction of the trim plate 18. Assuming that the depth D of the mortise M formed in frame F is greater than the combined thicknesses of trim plate 18 and adjustable hinge plate 14, set screws 17 are rotated so as to project by a distance which, when collectively added to the thicknesses of trim plate 18 and adjustable hinge plate 14, substantially equal the depth D of mortise M thereby assuring that the exposed surface 18c of trim plate 18 is substantially flush with the adjacent surface $F_s$ of frame F.

The embodiment of FIG. 6c is similar to that shown in FIG. 6b except that the set screws 17 project toward the base B of the mortise M in frame F. Preferably at least three threaded openings 141 and three associated set screws 17 are utilized to compensate for a situation in which the depth D of the mortise is greater than the combined thicknesses of the trim plate 18 and adjustable hinge plate 14.

FIG. 6d shows still another embodiment to compensate for a mortise M of increased depth D. As shown in FIG. 5, a shim plate 19 having slotted openings 19a–19c, which are similar in size to and designed to overlie the openings 14d–14f in adjustable hinge plate 14 is preferably positioned between adjustable hinge plate 14 and the base B of the mortise M in frame F.

Although the adjustable hinge plate 14 is preferably provided with elongated slots, which extend to adjacent edges of the adjustable hinge plate, the openings need not extend to the adjacent edges. Alternatively, the openings may be either circular, oblong or oval in shape, and of a size which is sufficiently greater than the outer diameter of the threaded fastener which is passed therethrough note for example, FIG. 4b in which slot 14e is replaced by opening O (shown in dotted fashion) whose size is greater than the size of at least that portion of the wood screw passing through the opening. The openings in shim plate may also be modified to assume shapes conforming to the modified shapes of the openings in adjustable hinge plate 14.

Although the preferred embodiment herein utilizes an adjustable hinge plate 14, which is mounted to the door frame, the adjustable hinge plate 14 may alternatively be mounted upon the door.

Although the description in which the manner in which the butt hinge is joined to the door has not been provided herein for purposes of simplicity, it should be understood that the assembly of a butt hinge to a door is similar to that described hereinabove for mounting the adjustable hinge plate to the door frame namely, the door is mortised in a similar manner and the fixed hinge plate is secured thereto by wood screws 15. In the event that the adjustable hinge plate is mounted thereto, the mounting is substantially similar except that the trim plate is mounted over the adjustable hinge plate and secured to the door by wood screws.

As a further alternative, the butt hinge assembly may be comprised of first and second adjustable hinge plates swingably joined to one another and provided with cooperating trim plates for securement respectively to the door and door frame.

The sleeves 14*a* of either the adjustable hinge plate 14 or the fixed hinge plate 12 may be offset slightly from the solid-line position shown in FIG. 5 (see 14*a*'), for example, to accommodate the thickness of the trim plate (or two trim plates, if two trim plates are used) while enabling the hinge plates and trim plates to lie in close engagement with one another when the door is fully closed.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. An adjustable butt hinge assembly for swingably mounting a door to a door frame comprising:

first and second hinge plates each having at least one integral pin receiving sleeve;

a pin extending through said sleeves for swingably coupling said first and second hinge plates;

each of said first and second plates having a plurality of openings, the openings of one of said plates being larger than the openings in a remaining one of said plates;

said one of said plates being placed against an end of a door;

said remaining one of said plates being placed against one surface of a door frame;

a first plurality of screw fasteners each having a threaded body portion and an integral head portion;

a cover plate placed over said one plate with larger openings, said cover plate having openings of a size similar to said smaller openings each positioned to overlie one of said larger openings;

said cover plate having a major surface engaging a major surface of said one plate, said major surfaces being flat to permit said one plate and said cover plate to slidably engage one another and to move relative to one another in mutually perpendicular directions;

said first plurality of screw fasteners each extending through an opening in said cover plate and a larger opening in the said one plate aligned therewith and threadedly engaging said door;

a head portion of each screw fastener overlying a marginal portion of the cover plate surrounding the opening to secure the cover plate against movement, thereby securing said one plate therebeneath against movement;

the larger openings having a diameter greater than a diameter of said threaded body portion extending therethrough to enable movement of said one plate in mutually perpendicular directions along said door relative to said cover plate and said door frame;

each of said one plate and said cover plate having at least three openings; and said one plate having said larger openings having four sides;

one of said sides having at least one integral pin receiving sleeve receiving said pin;

said larger openings each extending to an associated one of the remaining three sides to form a substantially U-shaped slot.

2. An adjustable butt hinge assembly for swingably mounting a door to a door frame comprising:

first and second hinge plates each having at least one integral pin receiving sleeve;

a pin extending through said sleeves for swingably coupling said first and second hinge plates;

each of said first and second plates having a plurality of openings, the openings of one of said plates being larger than the openings in a remaining one of said plates;

said one of said plates being placed against an end of a door;

said remaining one of said plates being placed against one surface of a door frame;

a first plurality of screw fasteners each having a threaded body portion and an integral head portion;

a cover plate placed over said one plate with larger openings, said cover plate having openings of a size similar to said smaller openings each positioned to overlie one of said larger openings;

said cover plate having a major surface engaging a major surface of said one plate, said major surfaces being flat to permit said one plate and said cover plate to slidably engage one another and to move relative to one another in mutually perpendicular directions;

said first plurality of screw fasteners each extending through an opening in said cover plate and a larger opening in the said one plate aligned therewith and threadedly engaging said door;

a head portion of each screw fastener overlying a marginal portion of the cover plate surrounding the opening to secure the cover plate against movement, thereby securing said one plate therebeneath against movement;

the larger openings having a diameter greater than a diameter of said threaded body portion extending therethrough to enable movement of said one plate in mutually perpendicular directions along said door relative to said cover plate and said door frame; and at least one of said hinge plates being bent at a sleeve end to enable the hinge plates and the cover plate to be substantially parallel to one another when the hinge plate is in a closed position.

3. An adjustable butt hinge assembly for swingably mounting a door to a door frame comprising:

first and second hinge plates each having at least one integral pin receiving sleeve;

a pin extending through said sleeves for swingably coupling said first and second hinge plates;

each of said first and second plates having a plurality of openings, the openings of one of said plates being larger than the openings in a remaining one of said plates;

said one of said plates being placed against an end of a door;

said remaining one of said plates being placed against one surface of a door frame;

a first plurality of screw fasteners each having a threaded body portion and an integral head portion;

a cover plate placed over said one plate with larger openings, said cover plate having openings of a size similar to said smaller openings each positioned to overlie one of said larger openings;

said cover plate having a major surface engaging a major surface of said one plate, said major surfaces being flat to permit said one plate and said cover plate to slidably engage one another and to move relative to one another in mutually perpendicular directions;

said first plurality of screw fasteners each extending through an opening in said cover plate and a larger opening in the said one plate aligned therewith and threadedly engaging said door;

a head portion of each screw fastener overlying a marginal portion of the cover plate surrounding the opening to secure the cover plate against movement, to secure fastening of the cover plate, thereby securing said one plate therebeneath against movement;

the larger openings having a diameter greater than a diameter of said threaded body portion extending therethrough to enable movement of said one plate in mutually perpendicular directions along said door relative to said cover plate and said door frame; and said one of said plates being provided with a plurality of tapped openings, each threadedly engaged by a threaded set screw;

said set screws being adjustable to adjust a distance between a base of a mortise receiving said one plate and cover plate to align an exposed surface of the cover plate so as to be substantially flush with a surface of a door in which said mortise is formed.

4. A method for mounting a butt hinge assembly upon a support, comprising the steps of:

providing a butt hinge assembly comprised of a pair of hinge plates swingably joined to one another;

providing clearance openings in one of said hinge plates having a size substantially greater than portions of fastening screws passing therethrough and utilized to mount the hinge plate to said support;

forming a mortise in one surface of said support for receiving said one hinge plate, said mortise being formed so that a distance between end walls of said mortise is greater than a length of said one of said hinge plates;

placing said one hinge plate in said mortise and against a base of the mortise;

providing a cover plate having openings which overlie said clearance openings;

placing said cover plate upon said one of said hinge plates and into said mortise so that each opening in said cover plate overlies an associated opening in said one hinge plate, said mortise being of a size so that the cover plate is not movable when placed in the mortise, while said one hinge plate is movable therein;

inserting threaded screw members through each of the aligned openings in said cover plate and said one hinge plate and threading said screws into said support so that said one of said hinge plates, which is sandwiched between the base of said mortise and said cover plate, is firmly clamped therebetween so as to maintain said one hinge plate in position;

said one hinge plate being movable along the base of the mortise and adjustable in mutually perpendicular directions within said mortise simply by loosening said threaded screw members, realigning said one of said hinge plates and thereafter retightening said threaded screw members;

providing a plurality of tapped openings in said one hinge plate;

providing a plurality of threaded set screws;

threading each set screw into an associated one of said tapped openings;

adjusting said set screws so that exposed surfaces of heads of said set screws project outwardly from one major surface of said one hinge plate and against said cover plate whereby, when the combined thickness of the one hinge plate and cover plate is less than a depth of said mortise, said set screws may be adjusted to project a sufficient distance away from said major surface of said one hinge plate so that the total thickness of said one hinge plate, set screw projection and cover plate is substantially equal to the depth of said mortise to thereby position an exposed major surface of said cover plate so as to be flush with an adjacent surface of the support in which said mortise is formed.

* * * * *

UNITED STATES PATENT AND TRADEMARK OFFICE

CERTIFICATE OF CORRECTION

PATENT NO. : 5,752,291
DATED : May 19, 1998
INVENTOR(S) : Michael Snyder

It is certified that error appears in the above-identified patent and that said Letters Patent is hereby corrected as shown below:

ON TITLE PAGE

Delete Item [73] in its entirety i.e.,delete
"[73] Assignee: Olympus Optical Co., Ltd., Tokyo, Japan"

Signed and Sealed this

Eighth Day of February, 2000

*Attest:*

*Attesting Officer*

Q. TODD DICKINSON

*Commissioner of Patents and Trademarks*